4/24/84 XR 4,444,433

United States Patent [19]

Ricketts

[11] 4,444,433

[45] Apr. 24, 1984

[54] METHOD FOR FORMING AN IN SITU OIL SHALE RETORT IN DIFFERING GRADES OF OIL SHALE

[75] Inventor: Thomas E. Ricketts, Grand Junction, Colo.

[73] Assignee: Occidental Oil Shale, Inc., Grand Junction, Colo.

[21] Appl. No.: 365,303

[22] Filed: Apr. 5, 1982

[51] Int. Cl.[3] ..... E21B 43/247; E21B 43/263; E21C 41/10

[52] U.S. Cl. ..... 299/2; 166/259; 166/299; 299/13

[58] Field of Search ..... 166/259, 299; 299/2, 299/13; 102/311, 312

[56] References Cited

U.S. PATENT DOCUMENTS

| | | | |
|---|---|---|---|
| 4,017,119 | 4/1977 | Lewis | 299/2 |
| 4,149,595 | 4/1979 | Cha | 299/13 |
| 4,167,291 | 9/1979 | Ridley | 299/2 |
| 4,227,574 | 10/1980 | Cha | 299/2 X |
| 4,326,751 | 4/1982 | Ricketts | 299/2 |

*Primary Examiner*—George A. Suchfield
*Attorney, Agent, or Firm*—Christie, Parker & Hale

[57] ABSTRACT

An in situ oil shale retort is formed in a subterranean formation containing oil shale. The formation comprises at least one region of relatively richer oil shale and another region of relatively leaner oil shale. According to one embodiment, formation is excavated from within a retort site for forming at least one void extending horizontally across the retort site, leaving a portion of unfragmented formation including the regions of richer and leaner oil shale adjacent such a void space. A first array of vertical blast holes are drilled in the regions of richer and leaner oil shale, and a second array of blast holes are drilled at least in the region of richer oil shale. Explosive charges are placed in portions of the blast holes in the first and second arrays which extend into the richer oil shale, and separate explosive charges are placed in portions of the blast holes in the first array which extend into the leaner oil shale. This provides an array with a smaller scaled depth of burial (sdob) and closer spacing distance between explosive charges in the richer oil shale than the sdob and spacing distance of the array of explosive charges in the leaner oil shale. The explosive charges are detonated for explosively expanding the regions of richer and leaner oil shale toward the horizontal void for forming a fragmented mass of particles. Upon detonation of the explosive, greater explosive energy is provided collectively by the explosive charges in the richer oil shale, compared with the explosive energy produced by the explosive charges in the leaner oil shale, resulting in comparable fragmentation in both grades of oil shale.

29 Claims, 4 Drawing Figures

METHOD FOR FORMING AN IN SITU OIL SHALE RETORT IN DIFFERING GRADES OF OIL SHALE

BACKGROUND

1. Field of the Invention

This invention relates to in situ recovery of shale oil, and more particularly to a method for using different blasting techniques in differing grades of oil shale when forming an in situ oil shale retort.

2. Description of the Prior Art

The presence of large deposits of oil shale in the semi-arid, high plateau western region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; 4,043,598; 4,118,071; and 4,192,554; which are owned by the assignee of this application and incorporated herein by this reference. These patents describe in situ recovery of liquid and gaseous hydrocarbon materials from a subterranean formation containing oil shale, wherein such formation is explosively expanded toward one or more void spaces excavated in the formation for forming a fragmented permeable mass of formation particles containing oil shale within the formation, referred to herein as an in situ oil shale retort.

During processing of a fragmented mass, retorting gases are passed through the fragmented mass to convert kerogen contained in the oil shale to liquid and gaseous products, thereby producing retorted shale oil. One method of supplying hot retorting gases used for converting kerogen contained in oil shale includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting" . Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

When forming a fragmented mass, it is important that formation within the retort site be fragmented and displaced, rather than simply fractured to form a fragmented mass of reasonably high permeability; otherwise, too much pressure differential is required to pass a retorting gas through the fragmented mass. The particular techinques used for explosively expanding formation toward one or more void spaces within a retort site can affect the permeability of the fragmented mass. Bypassing portions of the fragmented mass by retorting gas can be avoided, for example, in a fragmented mass having reasonably uniform permeability in horizontal planes, section-by-section vertically, across the fragmented mass. Undesirable gas channeling through the fragmented mass can occur if there is non-uniform permeability.

Generally, when forming a fragmented mass, an array of blast holes are drilled in the zone of formation adjacent the void spaces excavated within the retort site. Explosive charges are placed in the blast holes and are detonated in a desired time delay sequence for explosively expanding formation toward the void spaces for forming the fragmented mass. It is important to develop a blasting technique that produces reasonably uniform particle size and void fraction in the fragmented mass for enhancing uniformity of permeability. It is also desirable to provide a blasting technique that makes efficient use of explosive energy. In this way, a fragmented mass with reasonably high and reasonably uniform permeability throughout the retort site can be achieved.

In situ retorts are commonly formed in formation having different average grades of oil shale section-by-section vertically through the retort site. The present invention is based on a recognition that the most effective use of explosive energy produced by an array of explosive charges is a function of the grade of oil shale within the retort site.

Oil shale deposits in the western United States occur in generally horizontal beds and within a given bed there are an extremely large number of generally horizontal deposition layers known as "varves". The kerogen content of the formation is typically nonuniformly dispersed throughout a given bed as the kerogen content varies from layer to layer.

The average kerogen content of formation containing oil shale can be determined by a standard "Fischer assay" in which a core sample customarily weighing 100 grams and representing one foot of core is subjected to controlled laboratory analysis involving grinding the sample into small particles which are placed in a sealed vessel and subjected to heat at a known rate of temperature rise to measure the kerogen content of the core sample. Kerogen content is usually stated in units of "gallons per ton", referring to the number of gallons of shale oil recoverable from a ton of oil shale heated in the same manner as in the Fischer analysis.

The average kerogen content of formation containing oil shale varies over a broad range from essentially barren shale having no kerogen content up to kerogen content of about 70 gallons per ton. Localized regions can have even higher kerogen contents, but these are not common. It is often considered uneconomical to retort formation containing oil shale having an average kerogen content of less than about 8 to 10 gallons per ton.

Formation containing oil shale which is suitable for in situ retorting can be hundreds of feet thick. Often, there are strata of substantial thickness within such formation having significantly different kerogen contents than other strata in the same formation. Thus, for example, in one formation containing oil shale in Colorado that is a few hundred feet thick, the average kerogen content is in the order of about 17 gallons per ton. Within this formation there are strata 10 feet or so thick in which the kerogen content is in excess of 30 gallons per ton. In another portion of the same formation, there is a stratum almost 30 feet thick having nearly zero kerogen content. Similar stratification of kerogen content occurs in many formations containing oil shale.

It has been found that greater energy and better distribution of explosive are needed to obtain a given particle size distribution and void fraction when rich oil shale is explosively expanded than are required to obtain similar particle size distribution and void fraction when lean oil shale is explosively expanded. Thus, it is desirable to develop a blasting technique for forming a fragmented mass that ensures effective use of explosive energy throughout a retort site having regions of various grades of oil shale. SUMMARY OF THE INVENTION Briefly, an in situ oil shale retort is formed within a retort site in a subterranean formation containing oil shale and having a region of relatively richer oil shale and a region of relatively leaner oil shale at different elevations within the retort site. At least one void space is excavated within the retort site, leaving a remaining portion of formation including the regions of richer and leaner oil shale adjacent such void space. An array of explosive charges placed in the region of richer oil shale has a shallower scaled depth of burial (sdob) than an array of explosive charges placed in the region of leaner oil shale. This provides greater explosive energy collectively among the explosive charges in the region of richer oil shale when compared with the explosive energy collectively provided by the explosive charges in the region of leaner oil shale.

In one form of the invention, greater spacing between explosive charges in the region of leaner oil shale is used when compared with the spacing between explosive charges in the region of richer oil shale. This provides the shallower sdob for the explosive charges in the region of richer oil when compared with the sdob of explosive charges in the region of leaner oil shale, as well as improving distribution of explosive. According to one technique for providing such a spacing difference among explosive charges, blast holes are drilled on a pattern which, in effect, comprises two superimposed arrays of blast holes. Explosive charges in one array are loaded for a larger sdob in the region of leaner oil shale and both arrays are loaded for a smaller sdob in the region of richer oil shale. The explosive charges in both arrays are detonated for explosively expanding both regions of formation toward void space within the retort site for forming a fragmented mass. The greater explosive energy and smaller spacing distance within the region of richer oil shale, compared with the explosive energy and spacing distance within the region of leaner oil shale, can produce comparable results in terms of fragmentation when forming the fragmented mass.

DRAWINGS

These and other aspects of the invention will be more fully understood by referring to the following detailed description and the accompanying drawings in which.

DETAILED DESCRIPTION

Figure 1:
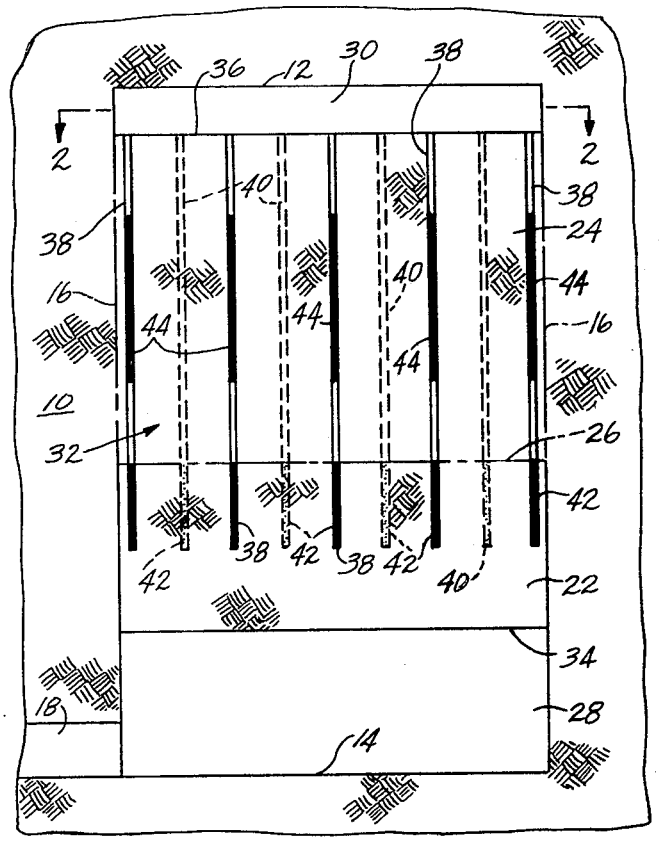
FIG. 1 is a fragmentary, semi-schematic vertical cross section, taken on line 1—1 of FIG. 2, showing arrays of blast holes drilled in a retort site of varying grades of oil shale according to principles of this invention.

FIG. 1 is a semi-schematic, vertical cross section illustrating an initial stage of development of an in situ oil shale retort being formed in accordance with principles of this invention. The in situ retort is formed in a retort site in a subterranean formation 10 containing oil shale. The in situ oil shale retort is generally rectangular in horizontal cross section, having a horizontal upper boundary 12, a horizontal lower boundary 14, and four vertically extending side boundaries 16 extending from the lower boundary to the upper boundary of the retort site. A drift 18 at a production level provides a means for access to the lower boundary of the in situ retort site.

Figure 4:
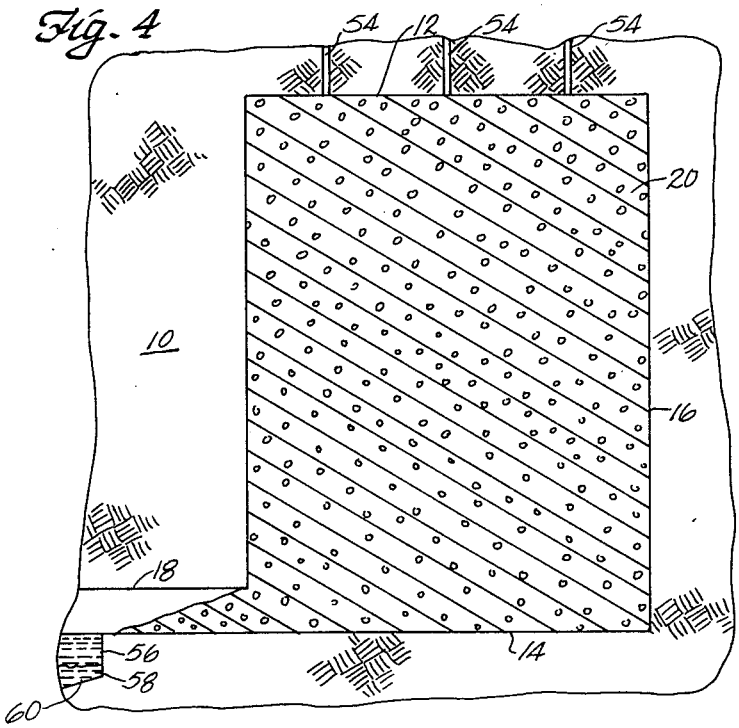
FIG. 4 is a fragmentary, semi-schematic vertical cross section illustrating a completed retort.

Generally speaking, at least one void space is excavated within the retort site, leaving a zone of unfragmented formation within the retort site adjacent each void space. Explosive charges placed in the zone of unfragmented formation are detonated for explosively expanding formation toward such void space for forming a fragmented mass 20 of formation particles (see FIG. 4) in the retort site.

Figure 2:
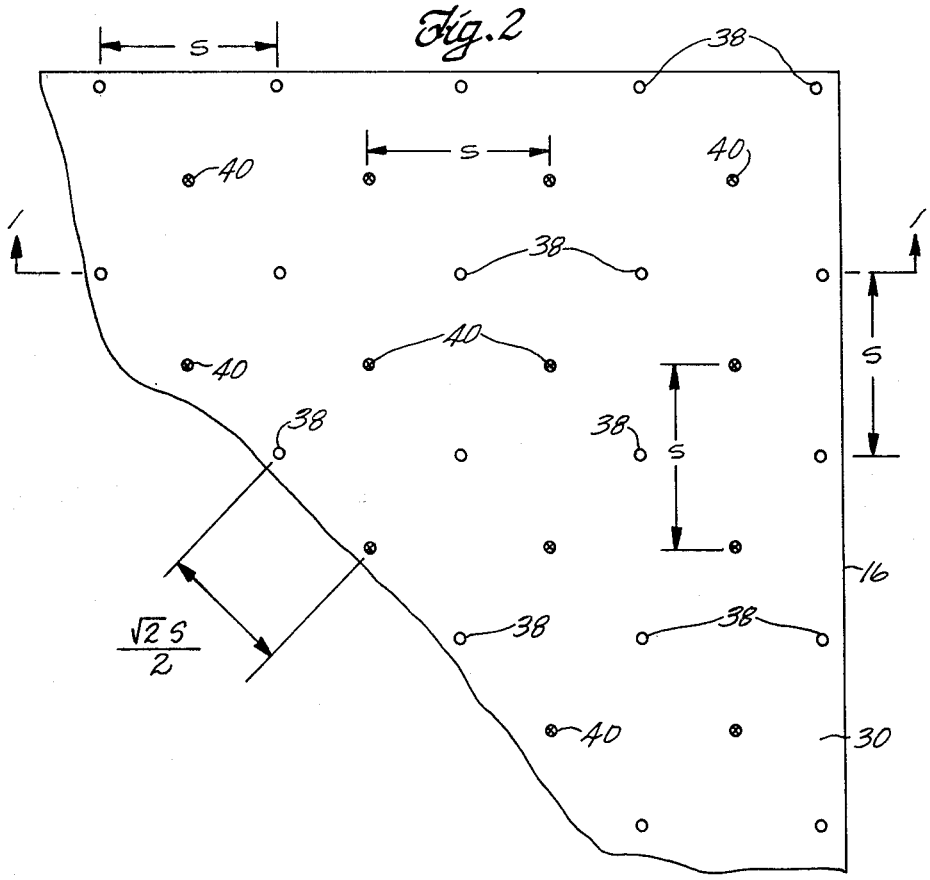
FIG. 2 is a fragmentary, semi-schematic horizontal cross-sectional view taken on line 2—2 of FIG. 1.

FIGS. 1 and 2 illustrate one embodiment of a method for forming the void spaces within the retort site prior to explosive expansion for forming the fragmented mass. In the embodiment of FIGS. 1 and 2, it will be assumed that formation within the retort site between the upper boundary 12 and the lower boundary 14 has a lower region 22 containing relatively richer oil shale and an upper region 24 containing relatively leaner oil shale. A phantom line 26 extends generally horizontally through the retort site representing the boundary between the upper region 24 of leaner oil shale and the lower region 22 of richer oil shale. It will be assumed for the purposes of this example that the lower region 22 of richer oil shale has an average Fischer assay of greater than about 20 gallons per ton, and the region 24 of leaner oil shale has a Fischer assay of less than about 20 gallons per ton.

In the embodiment illustrated in FIGS. 1 and 2, the in situ retort is formed by a two-level, horizontal free face mining system which includes a production level void 28 excavated generally horizontally across the lower boundary 14 of the retort site. The production level void, also referred to as a lower level void, has a horizontal cross section substantially the same as the horizontal cross section of the retort being formed. The production level void is excavated from access provided by the lower level drift 18. If desired, pillars (not shown) of unfragmented formation can be left in the production level void to provide temporary roof support for formation overlying the production level void.

An upper level void 30 is excavated generally horizontally across the retort site near the upper boundary 12 of the retort site. The upper level void has a horizontal cross section corresponding to the horizontal cross section of the retort being formed. The upper level void can be excavated by access provided by at least one upper level access drift (not shown) excavated on the same level as the upper level void. Pillars (not shown) of unfragmented formation can be left within the upper level void to provide temporary roof support for formation overlying the upper level void.

Excavation of the upper and lower voids leaves a zone 32 of unfragmented formation remaining within the boundaries of the retort site between the upper void and the lower void. Excavation of the production level void leaves a lower free face 34 of unfragmented formation extending horizontally across the bottom of the zone of unfragmented formation remaining within the retort site. Excavation of the upper level void leaves an upper free face 36 of unfragmented formation extending horizontally across the top of the zone of unfragmented formation remaining within the retort site. The zone of unfragmented formation 32 between the voids comprises the lower zone 22 of relatively richer oil shale and the upper zone 24 of relatively leaner oil shale.

The upper level void provides an open base of operation which provides effective access to substantially the entire horizontal cross section of the zone of unfragmented formation remaining within the retort site. The base of operation provides access for drilling and explosive loading for subsequently explosively expanding formation within the retort site for forming the fragmented mass 20. The upper base of operation also can provide a means of access for drilling and explosive loading for forming the production level void, if desired. As described in more detail below, the upper base of operation also provides a void space toward which formation can be explosively expanded for forming the fragmented mass.

Following excavation of the upper and lower voids, the remaining zone of unfragmented formation is explosively expanded upwardly and downwardly toward the upper free face 36 and the lower free face 34 for forming the fragmented mass within the boundaries of the retort site. According to principles of this invention, the remaining zone of unfragmented formation is explosively expanded by blasting techniques that vary with respect to locations of the regions of richer oil shale and leaner oil shale within the retort site. These principles will be described with respect to the example of FIG. 1 in which the region 22 of richer oil shale is located in a lower portion of the retort site above the lower free face 34 and the region 24 of leaner oil shale is located in an upper portion of the retort site below the upper free face 36.

A plurality of mutually spaced apart vertical blast holes are drilled downwardly from the upper level void into the zone of unfragmented formation remaining within the retort site. The vertical blast holes are arranged in spaced apart, parallel rows extending across the length and width of the retort site, with the blast holes in each row being spaced apart from one another along the length of the row. It is desirable to drill the blast holes in two square arrays, with the blast holes in one array being drilled within the confines of the other array, but offset laterally from the blast holes in the other array. Each array is referred to as a square array in the sense that blast holes in the array are drilled on a square matrix pattern in orthogonal, equidistantly spaced apart rows and columns across the horizontal cross section of the retort site, with the blast holes in each row also being equidistantly spaced apart. A square array of blast holes is more efficient than a rectangular array for optimum interaction of explosive charges during blasting and minimum usage of explosives.

A first array of vertical blast holes 38, illustrated as open circles in FIG. 2, are drilled in a square matrix pattern with a spacing distance S between adjacent blast holes in the first array. A second array of vertical blast holes 40, illustrated in FIG. 2 as circles containing an X, are also drilled in a square matrix pattern with the same spacing distance S between blast holes. As shown in FIG. 1, the blast holes in both arrays are drilled to substantially the same depth in the zone of unfragmented formation remaining within the retort site. It is desirable to drill each blast hole in both arrays from the upper level void, entirely through the upper region 24 of leaner oil shale, to a depth at about the midpoint of the lower region 22 of richer oil shale. That is, the bottoms of the blast holes in both arrays are about midway between the upper free face 34 of the lower void 28 and the horizontal boundary 26 separating the upper and lower regions of leaner and richer oil shale. In the embodiment illustrated in FIG. 1, the number of rows of blast holes illustrated is exemplary only, since a larger or smaller number of rows or columns of blast holes can be used if desired.

The blast holes in the second array are preferably drilled in rows and columns which are located approximately midway between adjacent rows and columns of blast holes in the first array. That is, the rows and columns of blast holes in the second array are spaced by one-half the spacing distance S from adjacent rows and columns of blast holes in the first array. Stated another way, the blast holes 40 in the second array are arranged so that each row of blast holes extends along a line midway between adjacent rows of blast holes 38 in the first array and each column of blast holes 40 in the second array extends along a line midway between adjacent columns of blast holes 38 in the first array. Several other ways of expressing the displacement of the second array from the first array also are possible. For instance, the blast holes in the second array are displaced from the blast holes in the first array so that each blast hole in the second array is at the intersection of the diagonals drawn between each group of four adjacent blast holes in the first array. The two arrays also can be viewed as having the second array superimposed symmetrically on the first array, and collectively the blast holes in the two superimposed arrays lie in a square array (or superlattice) twisted 45° from the orthogonal first and second arrays, in which case the blast holes in the superlattice have a spacing distance of $\sqrt{2}$ S/2 (see FIG. 2).

In the lower region 22 of richer oil shale, each of the blast holes 38 and 40 in both arrays is loaded with a separate columnar explosive charge 42. Each of the explosive charges in both arrays extends through portions of the blast holes from the boundary 26 between the upper and lower oil shale regions to a plane halfway between the boundary 26 and the horizontal free face 34 at the roof of the production level void 28. In the upper region 24 of relatively leaner oil shale, each of the blast holes 38 in the first array is loaded with a separate columnar explosive charge 44 which extends through portions of the blast holes in the middle half of the upper region 24. The portions of the other array of blast holes 40 extending through the upper region 24 of leaner oil shale do not receive explosive charges. The portions of each blast hole where there are no explosive charges are stemmed with an inert material. The blast holes in both arrays are preferably the same diameter, and the explosive charges 42 in both arrays in the region of richer oil shale all have approximately the same charge weight per blast hole. The explosive charges thus placed in the region of richer oil shale form an array having a smaller scaled depth of burial (sdob) and closer spacing distance between explosive charges than the charges in the region of leaner oil shale. The significance of the differing sdob and spacing distance is described below.

In forming the fragmented mass, the explosive charges 42 in the portions of the blast holes in the lower region of richer oil shale are first detonated. This causes explosive expansion of the lower region downwardly toward the horizontal free face 34 overlying the production level void, forming a lower portion of the fragmented mass.

Thereafter, either in a single round or after reloading the blast holes, the explosive charges 44 in the first array of blast holes in the upper region of leaner oil shale are detonated. This explosively expands the upper region both downwardly toward the new free face along the boundary 26 at the upper ends of the lower charges and upwardly toward the overlying free face at the floor of the upper level void. This forms a remaining portion of the fragmented mass which essentially fills the void space within the boundaries of the retort site, as illustrated by the fragmented mass 20 in FIG. 4.

In the illustrated embodiment the upper portion 24 of the zone of unfragmented formation is twice as thick (from the plane 26 to the upper free face 36) as the lower portion 22 (from the plane 26 to lower free face 34). When the lower portion is explosively expanded, it expands toward the lower free face. When the upper portion is explosively expanded, half is expanded downwardly toward a new free face at the plane 26 between the two portions and half is expanded upwardly toward the upper free face 36. The two halves can be considered separately for calculating sdob, the lower half of each explosive charge 44 acting on the lower half of the portion and the upper half of the charges acting on the upper half of the portion. Thus in effect, each explosive charge in the upper portion 24 has the same effective charge weight as each explosive charge 42 in the lower portion 22 of the zone of unfragmented formation.

Thus, a method has been described in which oil shale within a retort site is explosively expanded toward one or more horizontal free faces by explosive charges placed in vertical blast holes extending perpendicular to each free face. It has been found that when a fragmented mass is formed according to such techniques in formation containing regions of rich and lean oil shale at different elevations, the sdob of the array of explosive charges that is best for such explosive expansion is a function of the grade of the oil shale. For instance, lean oil shale, i.e., oil shale having Fischer assay less than about 20 gallons per ton, requires less explosive energy for explosive expansion than rich oil shale having a Fischer assay greater than about 20 gallons, for comparable results in terms of fragmentation upon detonation of explosive. The equivalent point charge scaled depth of burial or sdob preferred for rich oil shale is in the range of from about 6 to about 9 mm/cal$^{1/3}$, while for lean oil shale the sdob can be as much as about 9 to about 13 mm/cal$^{1/3}$. Additional information concerning the desired sdob for fragmenting oil shale is included in my U.S. patent application Ser. No. 91,346, filed Nov. 5, 1979, entitled "Cratering in the Deep Cratering Region to Form an In Situ Oil Shale Retort", now U.S. Pat. No. 4,336,966; and which is hereby incorporated by reference.

The explosive charges in the region of rich oil shale have a closer spacing distance, which produces a smaller sdob, when compared with the explosive charges in the region of lean oil shale, which have a wider spacing distance which produces a greater sdob. Thus, the explosive charges in the region of rich oil shale collectively produce greater explosive energy than the explosive energy produced collectively by the explosive charges in the region of lean oil shale. The smaller sdob for rich oil shale, and the corresponding greater explosive energy, keeps the particle size and bulking for the rich oil shale region about the same as the particle size and bulking produced by the greater sdob of explosive in the lean oil shale region.

The sdob of an explosive charge is a measure of the ability of the explosive charge, or array of charges, to explosively expand formation and can be expressed in units of distance over weight, or preferably energy, of explosive to the one-third power. The sdob as used herein refers to the equivalent point charge scaled depth of burial of an array of explosive charges. Each charge has a certain equivalent point charge scaled depth of burial that can be the same as or different from the sdob of the array. The sdob of the array can also be expressed as an equivalent of a plane of explosive at a certain depth of burial. A variety of terms are used herein such as sdob, scaled depth of burial, etc. and all refer to the equivalent point charge scaled depth of burial of an array of explosive charges.

The equivalent point charge scaled depth of burial of an array of cylindrical explosive charges, as provided in the upper and lower zones illustrated in FIG. 1, is expressed by the equation $$sdob = \frac{(D \cdot S^2)^{\frac{1}{3}}}{w^{\frac{1}{3}}}$$

where the actual array depth of burial D is equal to the individual charge depth of burial of the center of mass of the explosive column; S is the spacing distance between explosive charges in the array; and w is the charge weight (or energy) per blast hole in the array. The individual charge depth of burial D is measured vertically from the center of mass of each column of explosive to the nearest free face. The charge weight w per blast hole is preferably a measure of explosive energy. Given the density of the particular explosive charge used, in gm/cc, and given the explosive energy of the particular explosive, in cal/gm, the explosive energy, in calories, of each individual charge can be determined, knowing the volume of the explosive charge.

In the illustrated embodiment, if it is assumed that the upper region of formation has a height of 100 feet and the blast holes are drilled on 30-foot centers and each blast hole is drilled with a diameter of 12½ inches, the volume of each half of the upper explosive charge is about $6.03\times10^5$ cc. The actual depth of burial of each half charge is 37.5 feet. Assuming that a typical explosive has a density of 1.13 g/cc and an explosive energy of 975 cal/gm, the explosive energy w of each half of an individual explosive charge is about $6.65\times10^8$ calories. The sdob for each half of the array of explosive charges 44, as expressed by the equation above, is 11.3 mm/cal$^{1/3}$.

In the same illustrated embodiment, if it is assumed that the lower region of unfragmented formation has a height of 50 feet and the explosive columns have a height of 25 feet, the volume of each individual explosive charge is also about $6.03\times10^5$ cc. Assuming the same explosive is used, the individual charge weight or explosive energy of each explosive charge 42 is also about $6.65\times10^8$ calories. The individual charge depth of burial is 37.5 feet and the spacing distance between charges is 30 feet times $\sqrt{2}/2$, or 21.2 feet. The sdob for the explosive charges in the lower zone of richer oil shale is about 8.9 mm/cal$^{1/3}$.

Referring to the equation for sdob, it can be seen that the selected sdob for a given array of explosive charges can be controlled by varying either the individual charge depth of burial D, the spacing distance S, or the weight w (or energy) per explosive charge. Assuming that the actual depth of burial and the charge weight per blast hole are the same, or approximately the same, for charges in the regions of rich oil shale and lean oil shale, then the sdob of the array of charges in the rich oil shale is less than the sdob of the array of charges in the lean oil shale, since the spacing distance S between charges in the rich oil shale is smaller. Thus, arrays of explosive charges in formation having different grades of oil shale can be arranged with differing scaled depths of burial by arranging the blast holes in each grade of oil shale with approximately the same individual depths of burial and with the blast hole diameter and charge weight per blast hole being approximately the same, while the number of explosive charges can be increased to reduce the spacing distance for each region of richer oil shale content.

It is also found desirable to have the spacing distance between explosive charges be less for rich oil shale than for lean oil shale. This better distribution of explosive in the formation being expanded contributes to better fragmentation, namely a smaller average particle size and higher void fraction, as compared with expansion using the same total amount of explosive with greater spacing distance between charges.

When an in situ oil shale retort is formed in formation having differing grades of oil shale at differing elevations, the desired sdob of the array of explosive charges can differ at different elevations. Where several zones with differing grades of oil shale are present, the sdob of the arrays of explosive charges placed in each zone is generally inversely proportional to the grade of oil shale; i.e., as kerogen content increases, the sdob decreases. The techniques illustrated in FIGS. 1 and 2, for example, can provide differing arrays of explosive charges without drilling an excessive number of blast holes, or without drilling blast holes of a variety of sizes. That is, the blast holes can be drilled in two superimposed square arrays with all blast holes in both arrays being of the same diameter. All blast holes in each zone can have the same charge weight per blast hole. However, explosive charges placed in the zone or zones of richer oil shale content can have a closer spacing than the explosive charges placed in the blast holes in the zone or zones of leaner oil shale content to provide the differing sdob. Thus, drilling and explosive loading is somewhat simplified, while subsequent detonation of explosive produces explosive expansion that is best for each grade of oil shale, insofar as permeability and bulking are concerned.

Alternatively, other modifications of this approach can be used to obtain a desired sdob for an oil shale retort with upper and lower regions of differing grades of oil shale similar to those shown in FIG. 1. For instance, different actual depths of burial of the explosive charges in the two regions can be used, while the spacing distances between explosive charges in the upper and lower regions can be more or less the same.

Figure 3:
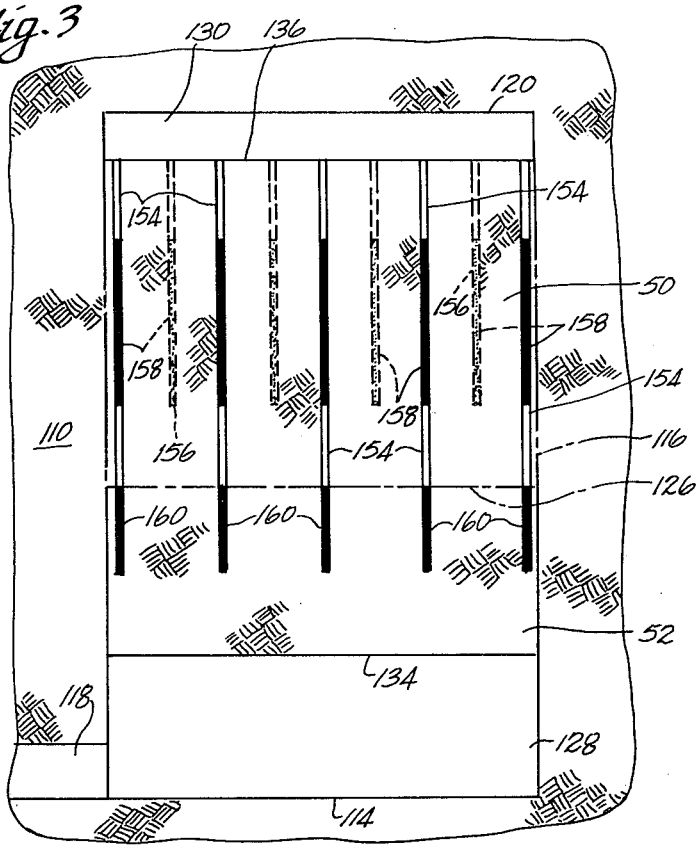
FIG. 3 is a fragmentary, semi-schematic vertical cross section showing an alternative arrangement of blast holes drilled in formation having varying grades of oil shale.

FIG. 3 illustrates an alternative embodiment of an in situ retort in which portions of the retort common to portions of FIG. 1 are indicated by the same reference numeral increased by 100. In this embodiment, a thicker region 50 of richer oil shale overlies a thinner region 52 of leaner oil shale. A first array of blast holes 154 are drilled downwardly through the two regions of richer and leaner oil shale. The first array is similar to the first array in the embodiment of FIG. 1, in that the blast holes 154 are drilled in a square array across the horizontal cross section of the retort site. The blast holes in the first array are drilled entirely through the upper region 50 of richer oil shale and to about the midpoint of the lower region 52 of leaner oil shale. A second array of blast holes 156 are drilled, also on a square array having the same spacing distance as the blast holes in the first array. The second array of blast holes is displaced from the first array in the same manner as in the embodiment of FIG. 1. That is, each of the blast holes in the second array is at the intersection of diagonals between four adjacent blast holes in the first array. The blast holes 156 in the second array are drilled to approximately three-fourths the depth of the upper region 50 of richer oil shale.

In the upper region of rich oil shale, each of the blast holes in the first and second arrays is loaded with an explosive charge which extends through the middle half of the upper region. In the lower region of lean oil shale, the blast holes in the first array receive an explosive charge 160 which extends through the upper half of the lower region.

The equivalent point charge scaled depth of burial of the array of explosive charges in the upper region 50 of rich oil shale is smaller than the sdob of the array of explosive charges in the lower region 52 of lean oil shale. Referring to the equation for sdob described above, the actual depth of burial D for the individual explosive charges in both regions is about the same and the charge weight w, or explosive energy, per blast hole is the same in each array. The spacing distance S among charges in the upper region is closer than in the lower region, which provides the smaller sdob for the explosive charges in the upper region, as compared with the explosive charges in the lower region.

As in the embodiment of FIGS. 1 and 2, the explosive charges in the lower region are detonated, causing explosive expansion of the lower region toward the horizontal free face 134 overlying the production level void 128. Thereafter, the explosive charges 158 in the first and second arrays of blast holes in the upper zone are detonated, causing explosive expansion of the upper region 50, both upwardly toward the upper void 130 and downwardly toward the new horizontal free face at the boundary 126. Such explosive expansion forms a fragmented mass similar to the fragmented mass 20 illustrated in FIG. 4.

During subsequent retorting operations, the fragmented mass is ignited near its top boundary for establishing a combustion zone in an upper portion of the fragmented mass. After ignition, air or other suitable retort inlet mixture is introduced through passages 54 that lead into the upper portion of the fragmented mass. Combustion gas produced in the combustion zone passes downwardly through the fragmented mass to establish a retorting zone on the advancing side of the combustion zone, where kerogen in the oil shale is retorted to produce liquid and gaseous products of retorting. The liquid products, including shale oil 56 and water 58, pass to the bottom of the fragmented mass and pass into a sump 60 in the production level void 18. An off gas containing gaseous products passes to the bottom of the fragmented mass and into the production level drift. The liquid products and the off gas are separately withdrawn from the production level drift. Off gas can be withdrawn from the lower production level drift by a blower (not shown) connected to a gas withdrawal line sealed through a bulkhead (not shown) in a principal production level drift that communicates with the production level drift 18. The shale oil which collects in the sump in the production level drift is withdrawn by an oil withdrawal line connected to an oil pump. The water is withdrawn from the sump through a separate water line connected to a water pump.

Although described in an embodiment where oil shale is explosively expanded downwardly in a plurality of lifts or layers toward an underlying void with the uppermost layer expanded toward an overlying void, it will be apparent that similar principles are applicable for explosively expanding formation toward other patterns of voids such as, for example, spaced apart, horizontally extending voids arranged as in U. S. Pat. No. 4,192,554, or in a plurality of lifts or layers toward a single underlying void as described in either of U.S. patent applications Ser. No. 67,921, filed by William D. Langford on Aug. 20, 1979, now abandoned for continuation Ser. No. 230,014, filed Feb. 12, 1981, now U.S. Pat. No. 4,349,227, or Ser. No. 70,319, (now abandoned), filed by Chang Yul Cha on Aug. 27, 1979, both of which are assigned to Occidental Oil Shale, Inc., assignee of this application, and which are hereby incorporated by reference. It will also be apparent that blast holes of larger diameter or larger explosive columns or more energetic explosive can be used in regions of relatively richer oil shale, as compared with regions of leaner oil shale, to provide the desired smaller sdob for the rich oil shale as compared with the region of lean oil shale.

It is also possible to provide a smaller sdob in a region of rich oil shale, compared with the sdob in a region of lean oil shale, so that upon detonation the smaller sdob produces somewhat higher permeability and bulking in the region of rich oil shale when compared with the permeability and bulking in the region of lean oil shale. This can be done to take into account the greater thermal expansion of rich oil shale during retorting operations, when compared with the thermal expansion of lean oil shale. This phenomenon is described in more detail in U.S. Pat. No. 4,167,291, which is incorporated herein by this reference.

Although two square arrays of blast holes have been described, it is also possible to use three superimposed matrix patterns of blast holes, for example, in a retort having three regions of varying grades of oil shale. This can be achieved, for example, by superimposing three arrays of blast holes symmetrically. That is, if blast holes in the first array have a spacing distance S, the rows and columns of blast holes in the second array can be spaced from the first array by a distance of one-third S, and the rows and columns of blast holes in the third array can be spaced from the second array by a distance of one-third S. In this example, all blast holes could be used for explosive charges in the region of richest oil shale; alternating blast holes could be used for the region of intermediate oil shale content; and one-third of the blast holes could be used for the leanest oil shale region. Alternatively, in a retort with three regions of differing grades of oil shale, two square arrays of blast holes and different spacing distances as in FIGS. 1 and 2 can be used for the leanest and richest oil shale regions, while explosive charges in the region of intermediate oil shale content can have the actual depth of burial or charge weight or explosive energy varied to provide an intermediate sdob value.

It is also possible to utilize principles of this invention in a vertical free face blasting arrangement, such as in U.S. Pat. No. 4,167,291, in which formation within the retort site is explosively expanded toward a vertical slot-shaped void. In such an arrangement, vertical blast holes can be drilled with the same diameter, but higher energy explosive can be used in portions of the blast holes that extend through the region of rich oil shale, to provide a lower sdob in the richer oil shale. Alternatively, the blast holes can be reamed to wider diameters in the rich oil shale and a greater amount of the same type of explosive can be placed in the wider portions of the blast holes to provide the lower sdob in the region of rich oil shale.

What is claimed is:

1. A method for recovering liquid and gaseous products from an in situ oil shale retort formed in a retort site in a subterranean formation containing oil shale and having at least one region of relatively richer oil shale and at least one region of relatively leaner oil shale extending across the retort site at different elevations within the retort site, such an in situ oil shale retort containing a fragmented permeable mass of formation particles containing oil shale, the method comprising the steps of:

excavating formation from within the retort site for forming at least one void space extending generally horizontally across the retort site, leaving a portion of unfragmented formation, including said regions of richer and leaner oil shale, within the retort site adjacent such a void;

drilling a first array of mutually spaced apart vertical blast holes that extend into the region of relatively richer oil shale and the region of relatively leaner oil shale;

drilling a second array of mutually spaced apart vertical blast holes that extend at least into the region of relatively richer oil shale, the blast holes in the second array of blast holes being interspersed with and spaced apart laterally from the blast holes in the first array of blast holes;

placing exposive charges in portions of the first array of blast holes in the region of richer oil shale;

placing explosive charges in portions of the second array of blast holes in the region of richer oil shale adjacent the explosive charges in the first array of blast holes;

placing explosive charges in portions of the first array of blast holes in the region of leaner oil shale, leaving a wider average spacing distance between explosive charges in the region of leaner oil shale than the average spacing distance between explosive charges in the region of richer oil shale;

detonating the explosive charges in both arrays of blast holes for explosively expanding the region of richer oil shale and for separately explosively expanding the region of leaner oil shale toward such void for forming a fragmented permeable mass of formation particles containing oil shale within the retort site;

establishing a retorting zone in an upper portion of the fragmented mass;

introducing a retorting gas into the fragmented mass for sustaining the retorting zone and for advancing the retorting zone through the fragmented mass for producing liquid and gaseous products of retorting within the fragmented mass; and withdrawing the liquid and gaseous products of retorting from a lower portion of the fragmented mass on the advancing side of the retorting zone.

2. The method according to claim 1 including drilling the first array of blast holes on a square array across the horizontal cross section of the retort site; and drilling the second array of blast holes on a square array having rows and columns of blast holes approximately midway between adjacent rows and columns of blast holes in the first array.

3. The method according to claim 2 including placing the explosive charges in both arrays of blast holes so that the array of explosive charges in the region of richer oil shale has an sdob less than the sdob of the array of explosive charges in the region of leaner oil shale.

4. The method according to claim 1 including placing the explosive charges in both arrays so that the array of explosive charges in the region of richer oil shale has an sdob less than the sdob of the array of explosive charges in the region of leaner oil shale.

5. The method according to claim 1 including drilling the blast holes in both arrays with substantially the same diameter.

6. The method according to claim 1 including placing explosive charges of substantially the same charge weight per blast hole in both arrays of blast holes within the region of richer oil shale.

7. A method for forming an in situ oil shale retort in a retort site within a subterranean formation containing oil shale and having at least one region of relatively richer oil shale and at least one region of relatively leaner oil shale within the retort site, such an in situ oil shale retort containing a fragmented permeable mass of formation particles containing oil shale, the method comprising the steps of:

excavating formation from within the retort site for forming at least one free face extending across the retort site, leaving a portion of unfragmented formation including such regions of richer and leaner oil shale extending across the retort site adjacent such a free face;

placing an array of mutually spaced apart explosive charges in the region of richer oil shale;

placing another array of mutually spaced apart explosive charges in the region of leaner oil shale, the array of explosive charges in the region of leaner oil shale having a greater equivalent point charge scaled depth of burial (sdob) than the array of explosive charges in the region of richer oil shale; and detonating the explosive charges in the regions of leaner and richer oil shale for forming a fragmented permeable mass of formation particles containing oil shale in the in situ oil shale retort.

8. The method according to claim 7 including loading the explosive charges in the region of richer oil shale for forming an array having an sdob in the range of from about 6 to about 9 mm/cal$^{\frac{1}{3}}$, and loading the explosive charges in the region of leaner oil shale for forming an array having an sdob in the range of from about 9 to about 13 mm/cal$^{\frac{1}{3}}$.

9. The method according to claim 7 including placing the explosive charges in both arrays of blast holes so that the average spacing distance between explosive charges in the region of richer oil shale is less than the average spacing distance between explosive charges in the region of leaner oil shale.

10. The method according to claim 7 including placing an array of vertically extending columnar explosive charges in the region of richer oil shale in a square matrix pattern, and placing an array of vertically extending columnar explosive charges in the region of leaner oil shale in a square matrix pattern with wider spacing distance between explosive charges in the region of leaner oil shale than the spacing distance between explosive charges in the region of richer oil shale.

11. A method for forming an in situ oil shale retort in a retort site within a subterranean formation containing oil shale and having at least one region of atively richer oil shale and at least one region of relatively leaner oil shale within the retort site, such an in situ oil shale retort containing a fragmented permeable mass of formation particles containing oil shale, the method comprising the steps of:

excavating formation from within the retort site for forming at least one void space within the retort site, leaving a portion of unfragmented formation including said regions of richer and leaner oil shale within the retort site adjacent such a void space;

placing an array of mutually spaced apart explosive charges in the region of richer oil shale;

placing an array of mutually spaced apart explosive charges in the region of leaner oil shale, the explosive charges in the region of richer oil shale collectively providing greater explosive energy upon detonation than the amount of explosive energy collectively provided, upon detonation, by explosive charges in the region of leaner oil shale; and detonating the explosive charges in the regions of richer and leaner oil shale for explosively expanding formation within the retort site toward the void space for forming a fragmented permeable mass of formation particles containing oil shale within the retort site.

12. The method according to claim 11 including loading the explosive charges in the region of richer oil shale for forming an array with an equivalent point charge scaled depth of burial in the range of from about 6 to about 9 mm/cal$^{\frac{1}{3}}$, and loading the explosive charges in the region of leaner oil shale for forming an array with an equivalent point charge scaled depth of burial in the range of from about 9 to about 13 mm/cal$^{\frac{1}{3}}$.

13. The method according to claim 11 including placing the array of explosive charges in the region of richer oil shale with a closer average apacing distance between charges than the average spacing distance between explosive charges in the region of leaner oil shale.

14. A method for forming an in situ oil shale retort within a retort site in a subterranean formation containing oil shale and having at least one region of relatively richer oil shale and at least one region of relatively leaner oil shale extending across the retort site at different elevations within the retort site, such an in situ oil shale retort containing a fragmented permeable mass of formation particles containing oil shale, the method comprising the steps of:

excavating formation from within the retort site for forming at least one void space extending generally horizontally across the retort site, leaving a portion of unfragmented formation including said regions of richer and leaner oil shale within the retort site adjacent such a horizontal void;

drilling a first array of vertical blast holes on a square matrix pattern across the horizontal cross section of the retort site, with each blast hole in the first array extending into both the region of richer oil shale and the region of leaner oil shale;

drilling a second square array of vertical blast holes on a square matrix pattern across the horizontal cross section of the zone of the retort site, with each blast hole in the second array extending at least into the region of richer oil shale, the blast holes in the second array being arranged in rows and columns which are interspersed with, and spaced apart laterally from, adjacent rows and columns of blast holes in the first array;

placing explosive charges in portions of the blast holes in the first array located in the region of richer oil shale and placing separate explosive charges in portions of the blast holes in the first array of blast holes located in the region of leaner oil shale;

placing explosive charges in portions of the blast holes in the second array located in the region of richer oil shale adjacent the explosive charges in the first array, the array of explosive charges placed in the region of richer oil shale having a smaller equivalent point charge scaled depth of burial and a shorter spacing distance between explosive charges than the equivalent point charge scaled depth of burial and spacing distance of the array of explosive charges in the region of leaner oil shale; and detonating the explosive charges in the first and second arrays of blast holes for explosively expanding the regions of richer and leaner oil shale toward the horizontal void for forming a fragmented permeable mass of formation particles containing oil shale within the in situ oil shale retort site.

15. The method according to claim 14 including drilling both arrays of blast holes with substantially the same diameter in each blast hole.

16. The method according to claim 14 including placing the explosive charges in the blast holes within the region of richer oil shale with substantially the same charge weight in each blast hole.

17. The method according to claim 14 including loading the explosive charges in the region of richer oil shale for forming an array with an equivalent point charge scaled depth of burial in the range of from about 6 to about 9 mm/cal$^{\frac{1}{3}}$ and loading the explosive charges in the region of leaner oil shale for forming an array with an equivalent scaled point charge depth of burial in the range of from about 9 to about 13 mm/cal$^{\frac{1}{3}}$.

18. A method for forming an in situ oil shale retort within a retort site in a subterranean formation containing oil shale and having a region of leaner oil shale extending across the retort site at an elevation above a region of richer oil shale extending across the retort site, such an in situ oil shale retort containing a fragmented permeable mass of formation particles containing oil shale, the method comprising:

excavating formation from within the retort site for forming an upper void space extending generally horizontally across an upper level of the retort site;

excavating formation from within the retort site for forming a lower void extending generally horizontally across a level of the retort site below the upper void, leaving a portion of unfragmented formation including said regions of leaner and richer oil shale extending across the retort site between the upper and lower horizontal voids;

drilling a first array of vertical blast holes downwardly from the upper void through the region of leaner oil shale and into the region of richer oil shale, the blast holes in the first array being drilled on a square matrix pattern across the horizontal cross section of the retort site;

drilling a second array of vertical blast holes downwardly from the upper void through the region of leaner oil shale and into the region of richer oil shale, the blast holes in the second array being drilled on a square matrix pattern with rows and columns of the blast holes in the second array being drilled approximately midway between adjacent rows and columns of the blast holes in the first array;

placing explosive charges in portions of the blast holes within the first array in the region of leaner oil shale and placing separate explosive charges in portions of the blast holes in the first array in the region of richer oil shale;

placing explosive charges in portions of the blast holes in the second array in the region of richer oil shale adjacent the explosive charges in the first array, for providing an array having a greater equivalent point charge scaled depth of burial (sdob) and a wider spacing distance between the explosive charges placed in the region of leaner oil shale when compared with the sdob and spacing distance of the array of explosive charges placed in the region of richer oil shale;

detonating the explosive charges in the regions of richer and leaner oil shale for explosively expanding the regions of leaner and richer oil shale at least toward the lower void for forming a fragmented permeable mass of formation particles containing oil shale within the in situ oil shale retort site.

19. The method according to claim 18 including drilling the blast holes in both arrays with substantially the same blast hole diameter.

20. The method according to claim 18 including loading the explosive charges in the first and second arrays in the region of richer oil shale with approximately the same charge weight per blast hole.

21. The method according to claim 18 including detonating the explosive charges for explosively expanding the region of leaner oil shale both upwardly toward the upper void and downwardly toward the lower void for forming the fragmented mass.

22. The method according to claim 18 including placing the explosive charges in the region of richer oil shale for forming an array with an sdob in the range of from about 6 to about 9 mm/cal$^{\frac{1}{3}}$ and placing the explosive charges in the region of leaner oil shale for forming an array with an sdob in the range of from about 9 to about 13 mm/cal$^{\frac{1}{3}}$.

23. The method according to claim 18 including detonating the explosive charges in the first and second arrays within the region of richer oil shale for explosively expanding the region of richer oil shale downwardly toward the lower void, and thereafter detonating the explosive charges in the first array of blast holes in the region of leaner oil shale for explosively expanding the region of leaner oil shale toward void space remaining within the retort site.

24. A method for forming an in situ oil shale retort in a retort site in a subterranean formation containing oil shale and having a region of relatively richer oil shale extending across the retort site at an elevation above a region of relatively leaner oil shale extending across the retort site, such an in situ oil shale retort containing a fragmented permeable mass of formation particles containing oil shale, the method comprising the steps of:

excavating formation from within the retort site for forming an upper void space extending generally horizontally across an upper level of the retort site;

excavating formation from within the retort site for forming a lower void extending generally horizontally across a level of the retort site below the upper void, leaving a portion of unfragmented formation including said regions of richer and leaner oil shale extending across the retort site between the upper and lower voids;

drilling a first array of vertical blast holes downwardly from the upper void through the region of richer oil shale and into the region of leaner oil shale, the first array of blast holes being mutually spaced apart on a square matrix pattern extending across the horizontal cross section of the retort site;

drilling a second array of vertical blast holes downwardly from the upper void and into a portion of the region of richer oil shale, the blast holes in the second array being drilled on a square matrix pattern extending across the horizontal cross section of the retort site, the blast holes in the second array being drilled in rows and columns aligned approximately midway between adjacent rows and columns of the first array of blast holes;

placing explosive charges in portions of the first array of blast holes in the region of richer oil shale and placing separate explosive charges in portions of the first array of blast holes in the region of leaner oil shale;

placing explosive charges in portions of the second array of blast holes adjacent the explosive charges placed in the first array of blast holes in the region of richer oil shale; and detonating the explosive charges placed in the first and second arrays of blast holes for explosively expanding the regions of leaner and richer oil shale at least toward the lower void for forming a fragmented permeable mass of formation particles containing oil shale within the in situ oil shale retort site.

25. The method according to claim 24 including drilling the first and second arrays of blast holes with approximately the same blast hole diameter.

26. The method according to claim 24 including placing the explosive charges in the first and second arrays in the region of richer oil shale with approximately the same charge weight per blast hole.

27. The method according to claim 24 including placing the explosive charges in the region of richer oil shale for forming an array with an equivalent point charge scaled depth of burial in the range of from about 6 to about 9 mm/cal$^{\frac{1}{3}}$, and placing the explosive charges in the region of leaner oil shale for forming an array with an equivalent point charge scaled depth of burial in the range of from about 9 to about 13 mm/cal$^{\frac{1}{3}}$.

28. The method according to claim 24 including detonating the explosive charges in the region of leaner oil shale for explosively expanding the region of leaner oil shale toward the lower void, and thereafter detonating the explosive charges in the region of richer oil shale for explosively expanding the region of richer oil shale toward void space remaining within the retort site.

29. A method for forming an in situ oil shale retort in a retort site within a subterranean formation containing oil shale and having at least one region of oil shale having a Fischer assay of more than about 20 gallons per ton and at least one region of oil shale having a Fischer assay of less than about 20 gallons per ton within the retort site, such an in situ oil shale retort containing a fragmented permeable mass of formation particles containing oil shale, the method comprising the steps of:

excavating formation from within the retort site for forming at least one void space within the retort site, leaving a portion of unfragmented formation including said regions of richer and leaner oil shale within the retort site adjacent such a void space;

placing an array of mutually spaced apart explosive charges in the region of richer oil shale having an equivalent point charge scaled depth of burial in the range of from about 6 to about 9 mm/cal$^{\frac{1}{3}}$;

placing an array of mutually spaced apart explosive charges in the region of leaner oil shale having an equivalent point charge scaled depth of burial in the range of from about 9 to about 13 mm/cal$^{\frac{1}{3}}$; and detonating the explosive charges in the regions of richer and leaner oil shale for explosively expanding formation within the retort site toward the void space for forming a fragmented permeable mass of formation particles containing oil shale within the retort site.

* * * * *